US005355549A

United States Patent [19]

Steinberg et al.

[11] Patent Number: 5,355,549

[45] Date of Patent: Oct. 18, 1994

[54] DIVERTER VALVE FOR VACUUM CLEANER APPARATUS

[75] Inventors: Gary Steinberg, Jenison; Henry Rosendall, Grand Rapids, both of Mich.

[73] Assignees: Amway Corporation, Ada; Bissell Inc., Grand Rapids, both of Mich.

[21] Appl. No.: 850,679

[22] Filed: Mar. 13, 1992

[51] Int. Cl.[5] ..... A47L 5/32

[52] U.S. Cl. ..... 15/334; 15/339

[58] Field of Search ..... 15/331, 334, 335, 339

[56] References Cited

U.S. PATENT DOCUMENTS

| | | | |
|---|---|---|---|
| Re. 32,257 | 10/1986 | Dyson | 15/335 |
| 873,300 | 12/1907 | Cranston | 15/339 X |
| 1,217,817 | 2/1914 | Peters . | |
| 1,735,766 | 11/1929 | Kantz | 15/339 X |
| 1,929,025 | 10/1933 | Leathers | 15/339 X |
| 1,936,761 | 11/1933 | Hoover . | |
| 1,953,944 | 4/1934 | Becker . | |
| 2,070,689 | 2/1937 | Smellie . | |
| 2,103,101 | 12/1937 | Taylor . | |
| 2,175,642 | 10/1939 | Replogle | 15/334 |
| 2,597,690 | 5/1952 | Wied | 15/339 X |
| 2,747,215 | 5/1956 | Segesman | 15/333 |
| 2,898,622 | 8/1959 | Hurd | 15/351 X |
| 3,300,806 | 1/1967 | Ripple | 15/334 |
| 3,869,751 | 3/1975 | Boyd et al. | 15/334 |
| 4,123,818 | 11/1978 | Hurwitz | 15/339 X |
| 4,376,322 | 3/1983 | Lockhardt et al. | 15/323 |
| 4,377,882 | 3/1983 | Dyson | 15/335 |
| 4,571,772 | 2/1986 | Dyson | 15/335 |
| 4,573,236 | 3/1986 | Dyson | 15/333 |
| 4,593,429 | 6/1986 | Dyson | 15/353 |

*Primary Examiner*—Chris K. Moore

*Attorney, Agent, or Firm*—Willian Brinks Hofer Gilson & Lione

[57] ABSTRACT

A vacuum diverter valve for a vacuum cleaner is located in a generally cylindrical valve housing with a vacuum outlet and first and second inlets circumferentially placed thereabout. The valve slideably engages the valve housing, and an interior wall on the valve defines a passage to allow communication between the vacuum outlet, and the first inlet or second inlet, or combination thereof. The valve is preferably formed with a clear plastic outboard endwall for viewing.

4 Claims, 3 Drawing Sheets

DIVERTER VALVE FOR VACUUM CLEANER APPARATUS

FIELD OF THE INVENTION

This invention relates to a vacuum cleaner valving mechanism for switching air flow between floor cleaning and an accessory. More specifically, this invention relates to a rotary vacuum diverter valve assembly for vacuum cleaners that is clear plastic and disposed to rotate about an axis perpendicular to the vacuum air streams that it diverts.

BACKGROUND OF THE INVENTION

In vacuum cleaners employing a floor cleaning means and an off the floor cleaning means, it is common to provide two modes of vacuum operation, i.e., floor vacuuming and an accessory cleaning tool, by way of a valving mechanism. Flap valves and some rotary valve arrangements have typically been used for vacuum stream control in this regard. These arrangements have not, however, been generally designed to accommodate the concerns of avoiding fouling by materials entrained in the vacuum stream, allowing for consumer accessibility and visibility to check for possible clogging, and further providing for throttling between floor cleaning and hose cleaning modes to allow for cleaning delicate subjects via reduced velocity at the suction ends of the appliance without varying the vacuum motor speed.

For example, there is described in U.S. Pat. No. 1,887,600 a rotary diverter valve which is transparent for viewing purposes and located at the T-shaped juncture of vacuum lines with an axis of rotation parallel to the main vacuum line. Upon rotation of the valve, a port in the cylindrical valve wall opens one of the dirty air lines and correspondingly closes the other line. U.S. Pat. No. 1,533,271 also discloses such a valve. This latter valve operates to divert the vacuum streams from either the floor cleaning member or the hose nozzle member, but does not allow for a combination thereof. The valve viewing panel, although initially clear, is also subject to abrasion over continuous use because the viewing panel forms part of the diverting elbow for the dirty air stream, and is therefore abraded by material entrained in the vacuum stream, and thus its long term function is jeopardized.

In U.S. Pat. No. 2,504,846 an opaque rotary diverter valve is located in a junction of vacuum lines with an axis of rotation parallel to the main vacuum line. The valve has an arcuate peripheral opening extending through nearly half the circumference of the valve which may be used to direct the vacuum to one of two dirty air lines. Even if this valve is changed to a clear material, its configuration suffers from the same disadvantage of only short term visibility through the viewing panel as the previously discussed valve, because the viewing panel forms part of the diverting elbow.

Other rotary diverter valves known in the art are somewhat inaccessible to the consumer in cases of plugging or partial clogging of the device (see FIGS. 1 & 2 discussed in more detail hereafter).

SUMMARY OF THE INVENTION

It is therefore a principal objective of the present invention to provide a rotary vacuum diverter valve for vacuum cleaners that will avoid partial or complete clogging as consistently as those valves already known but will also allow for long term viewing of the valve interior during operation to check for clogging materials, that is readily disassembled to remove any clog that is detected, and that can divert a vacuum stream between two dirty air sources simultaneously for a throttling feature.

It is another objective of the invention to provide a durable clear plastic rotary vacuum diverter valve which is economical in manufacture.

These objectives have been met in the present invention in a plastic diverter valve, which is placed in a generally cylindrical cavity defined in a vacuum cleaner housing. The cavity has located circumferentially thereabout a vacuum outlet orifice which communicates with the vacuum producing (suction) means, a first inlet which communicates with the floor cleaning member, and a second inlet which communicates with an accessory member. The cylindrical diverter valve has an outer sidewall that slideably engages the cavity and a generally planar interior wall that defines a passage which is proportioned to allow communication upon rotation thereof between the vacuum outlet and the first inlet, second inlet, or combination thereof.

In a preferred embodiment, the first and second inlets are angularly situated about the cavity at approximately 150°, and the vacuum outlet is therebetween, the generally planar wall defines a lunule-shaped passage in the diverter valve, and gaskets are placed about the periphery of the valve and passage defined therein, and a restraining means is provided to thereby confine the rotation of the valve.

The preferred embodiment is made of clear plastic, which may be frosted in certain areas. A clear window is provided, however, into the air passage of the diverter valve through the axial side of the valve, i.e., the side that faces the user. Since this clear window is parallel to the air stream, it provides long term ability to view the inside of the valve.

The foregoing features and advantages of the invention will be further understood upon consideration of the following detailed description of an embodiment of the invention taken in conjunction with the accompanying drawings, in which:

DETAILED DESCRIPTION OF A PRESENTLY PREFERRED EMBODIMENT OF THE INVENTION

Figure 1:
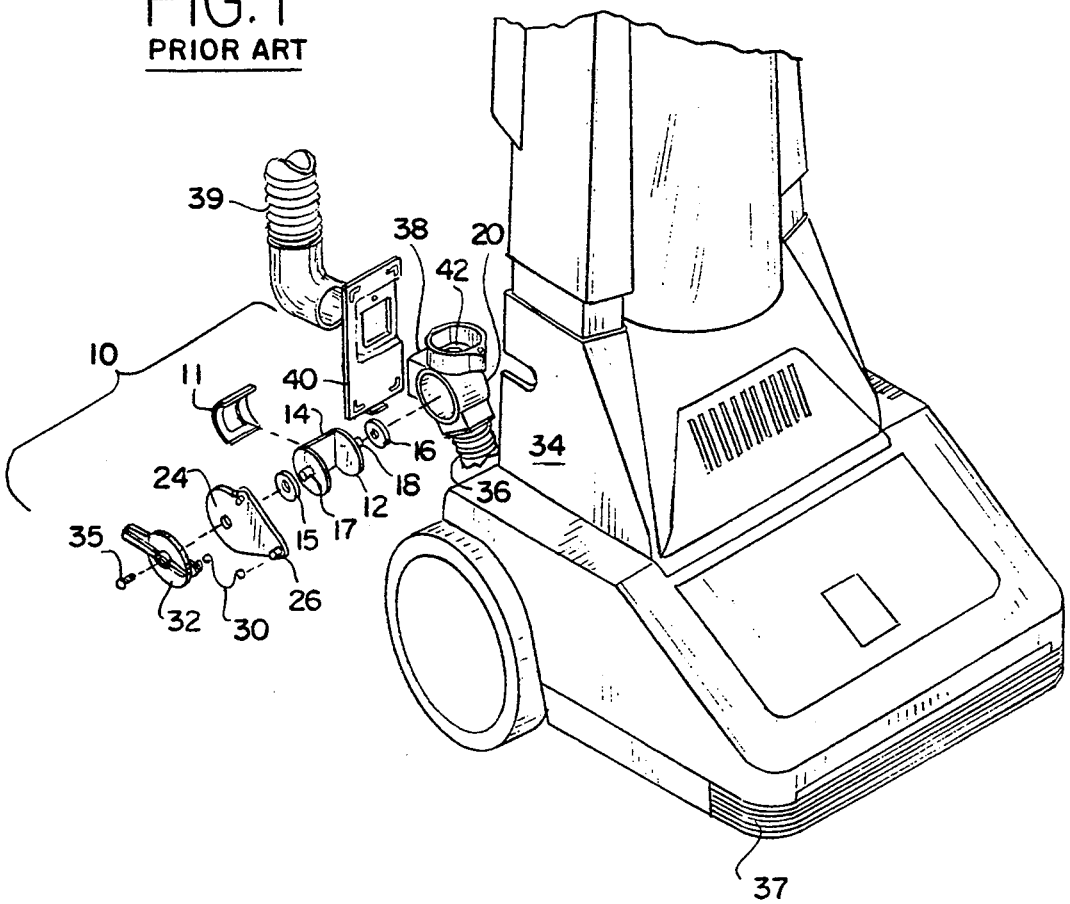
FIG. 1 PRIOR ART
FIG. 1 is an exploded perspective view of components used in assembling a known prior art valving device.
Figure 2:
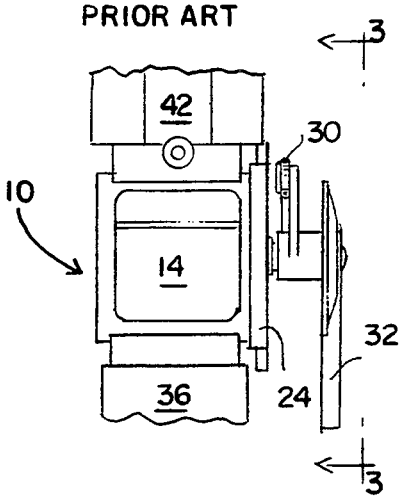
FIG. 2 PRIOR ART
FIG. 2 is a cross-sectional view of an assembled known prior art valving device.
Figure 3:
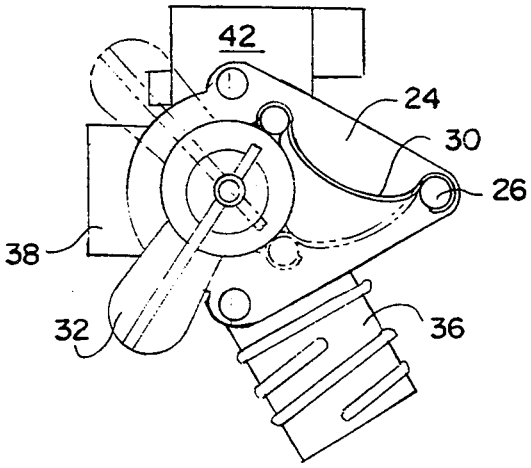
FIG. 3 PRIOR ART
FIG. 3 is a side view of an assembled known prior art valving device taken along line 3—3 of FIG. 2.

FIGS. 1 through 3 illustrate a known prior art vacuum cleaner similar in design to that described herein (sold by Amway Corporation under the trademark CMS 1000). With regard to FIG. 1, the diverter valve assembly, generally depicted as 10, is made of opaque plastic, and comprises diverter valve 12 with valve seal 11 affixed to valve panel 14, and diverter seals 15, 16 engaged on respective valve pins 17, 18 on either side of the valve. Pin 18 is inserted into a hole defined in diverter housing 20 and pin 17 mounted in a hole of housing cover 24.

The valve is positionable into only two modes of operation by means of spring 30 affixed at one end to a lever arm 26 of housing cover 24 and at the other end to an interior pin on selector lever 32, which is generally located on the exterior of the vacuum cleaner housing 34 and secured by screw 35 to diverter valve 12. The mode of operation is effectuated by the positioning of valve panel 14 blocking either first inlet 36 (communicating with the floor cleaning member 37), or second inlet 38 (communicating with the nozzle or wand assembly 39 for "off the floor" cleaning), from the vacuum source communicating with vacuum outlet 42.

As shown in FIG. 2, which depicts a side view of the assembled prior art valve with diverter cover 40 and nozzle assembly 39 removed, spring 30 biases diverter valve 12 so that panel 14 allows only for communication between vacuum outlet 42 and second inlet 38, and blocks first inlet 36. As is readily apparent from the geometry of the assembly, spring 30 biases the valve to only one other position (shown in phantom in FIG. 3). Thus, any sort of throttling between dirty air streams is effectively precluded.

The prior art valving assembly 10 is somewhat inaccessible, and thus not readily cleared of clogs. The plurality of components precludes an efficient method of disassembly by a user without hand tools. Moreover it is difficult to view potential clogged or fouled areas within valving assembly 10 even when partially disassembled.

Figure 4:
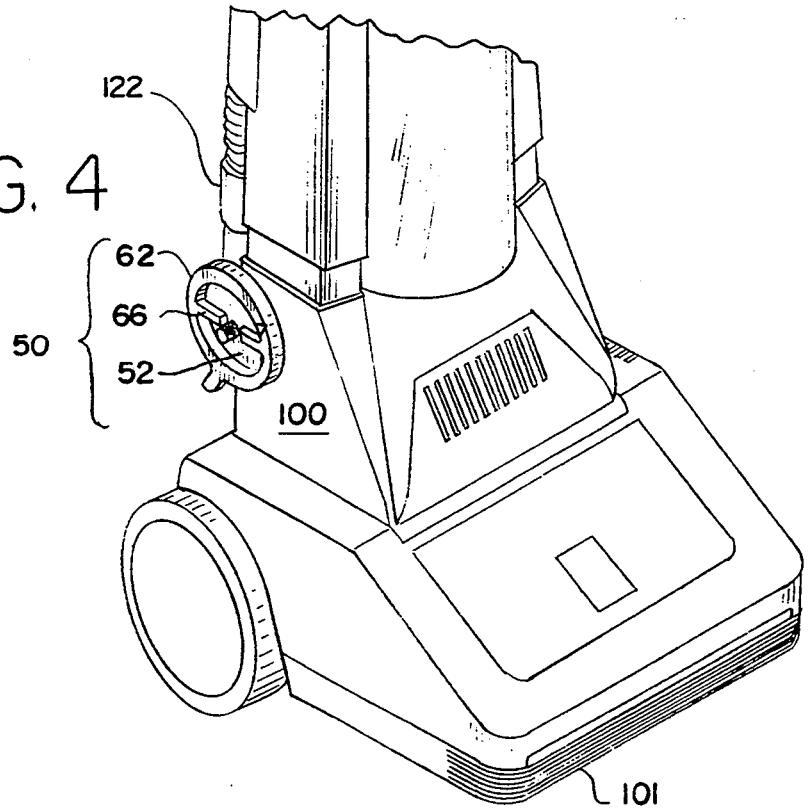
FIG. 4 is a perspective view of assembled components in an embodiment of the present invention.
Figure 5:
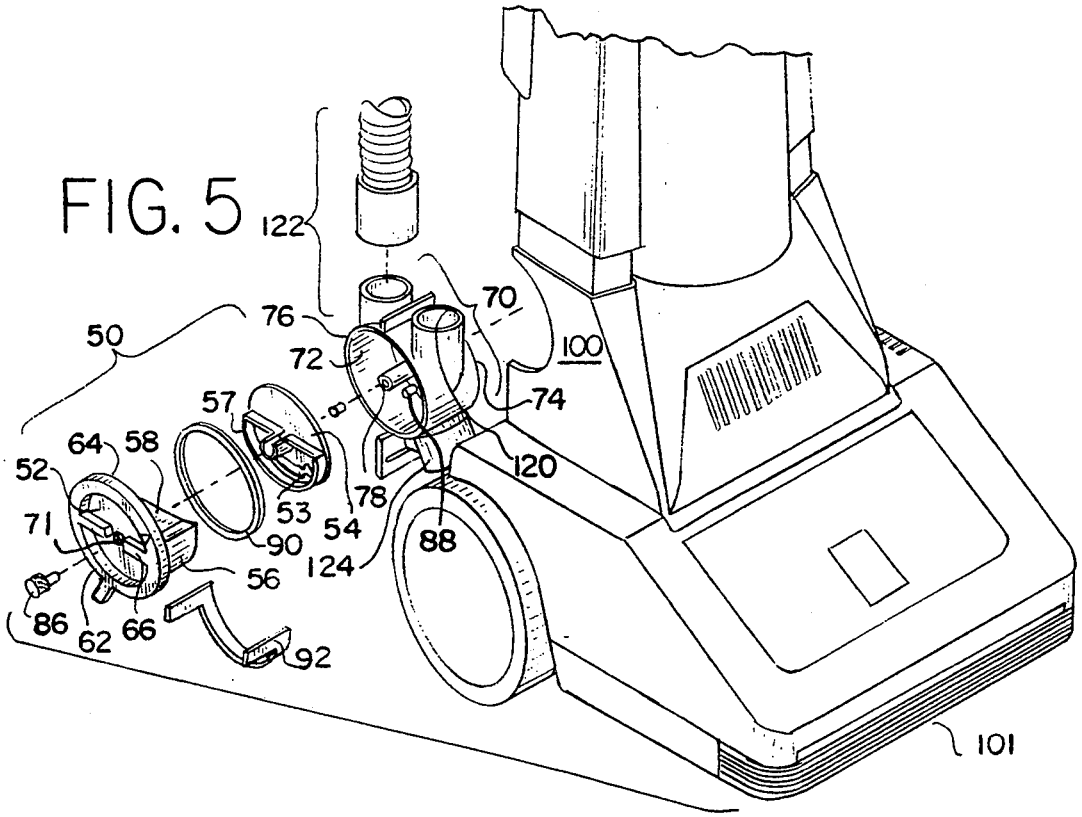
FIG. 5 is an exploded perspective view of some of the components used in the FIG. 4 embodiment.
Figure 8:
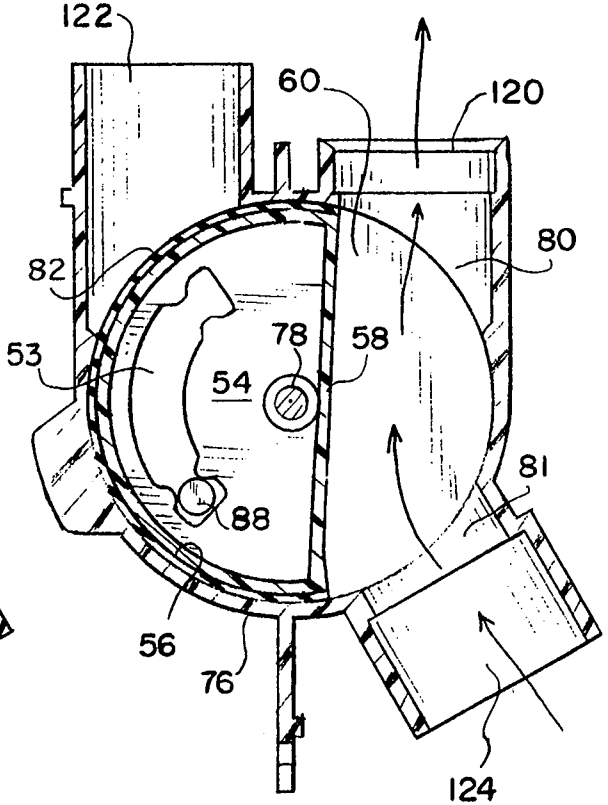
FIG. 8 is a cross-sectional view of the diverter valve of FIG. 4 in a position where the vacuum outlet communicates with a second inlet (dirty air source).
Figure 7:
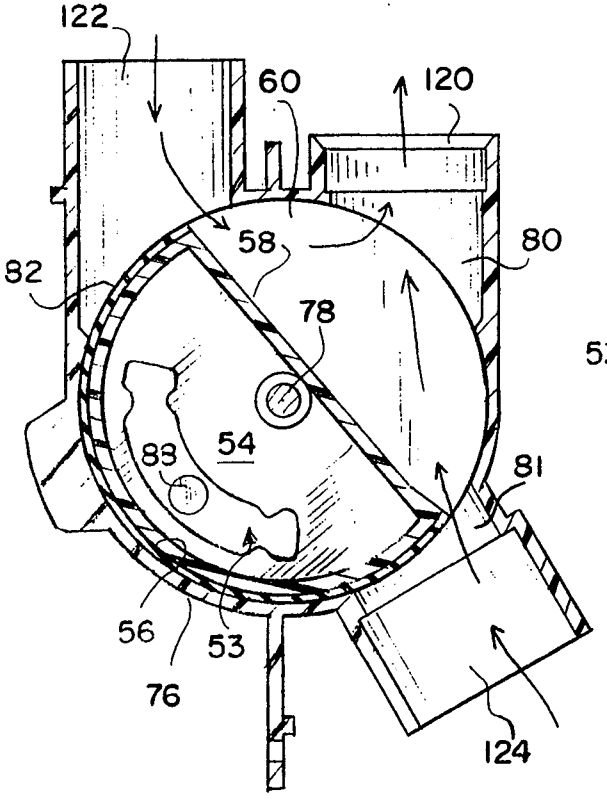
FIG. 7 is a cross-sectional view of the diverter valve of FIG. 4 in a position where the vacuum outlet communicates with first and second inlets (both dirty air sources)
Figure 6:
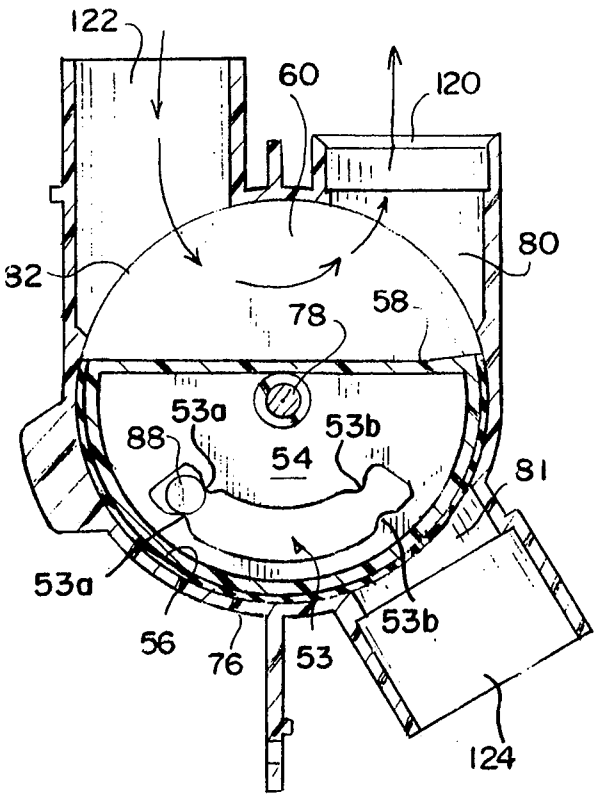
FIG. 6 is a cross-sectional view of the diverter valve of FIG. 4 in a position where the vacuum outlet communicates with a first inlet (one dirty air source)

The present invention is intended to overcome the above mentioned drawbacks in the preexisting diverter valve, as well as improve upon other prior art devices. In a preferred embodiment, diverter valve 50, shown in FIGS. 4 and 5, is generally cylindrical with outboard panel 52 and inboard panel 54, both of a general configuration akin to axial cylinder walls. Cylindrical side wall panel 56, and generally planar interior panel 58 are joined together, thereby defining lunule-shaped cross-section cavity 60 (FIGS. 6–8). Outboard panel 52 has integral therewith circumferential flange 62, with an inboard facing annular recess 64 therein, and outboard facing diametrical flanges 66. Axial hole 71, centered on panels 52 and 54, is provided in valve 50 for retaining means to rotatably engage the valve.

Within vacuum cleaner housing 100, as shown in FIG. 5, is diverter valve housing 70. Housing 70 has a valve annular cavity 72 defined by planar back wall 74, cylindrical side wall 76, and centered post 78. Valve 50 is fit within housing annular cavity 72 by sliding it over the post 78 via hole 71.

The valve assembly created may be alternated readily between modes of vacuum operation, as depicted in FIGS. 6–8, by merely rotating the valve with respect to the housing 70. In the preferred embodiment depicted herein, cylindrical wall 76 of housing 70 has vacuum outlet orifice 80, first inlet orifice 81 and second inlet orifice 82. The inlet orifices 81, 82 are angularly spaced approximately 150° on wall 76, and the vacuum inlet orifice 80 is approximately equidistant therebetween. In FIG. 6, valve 50 is positioned to a first mode of operation which allows vacuum outlet 80 to communicate with second inlet 82, that in the preferred embodiment leads to the wand member for "off the floor" cleaning. Valve 50 may be rotated clockwise, as depicted in FIG. 8, to a second mode of operation which effectively prevents communication between vacuum outlet 80 and second inlet 82, but allows for communication between outlet 80 and first inlet 81, that in the preferred embodiment leads to the floor cleaning member 101. If a throttling effect is desired, less rotation of valve 50 than that displayed in FIG. 8, such as that shown in FIG. 7, may create a throttled vacuum mode for both first and second inlets 81, 82. In this third mode of operation, rug cleaning and spot cleaning, such as cleaning draperies, may be performed by a vacuum user. This mode of operation allows for cleaning delicate objects with lower suction velocities at the ends of either the floor cleaning member (such as cleaning rugs, mats, and the like) or the wand cleaning member (such as drapes, plants, etc.). This method of reducing suction velocity is also preferable to typical bleeder valves located at the nozzle end, because such bleeders generally harm the vacuum efficiency for the nozzle during the first mode of operation due to typical air leaks that are often accentuated during the life cycle of the vacuum cleaner.

The housing 70 may be constructed of A.B.S. resin opaque plastic, and preferably G.E. Cycolac T 33881-1. Vacuum outlet 80 is located generally tangential to cylindrical cavity wall 76, with vertical hose 120 connecting to the vacuum means (conventional and not shown). Second inlet 82 is located generally tangential to cylindrical cavity wall 76 in an adjacent quadrant of cavity 72, with vertical hose attachment 122 connecting to a wand hose or other cleaning accessory for "off the floor" cleaning. First outlet 81 is located generally normal to cylindrical cavity wall 76 and is located in another quadrant of the cavity adjacent to the vacuum outlet quadrant, with floor dirty air hose attachment 124 connected to a hose communicating with the floor cleaning member 101. To allow an operator to distinguish between modes of operation, it is preferable to provide for mode detention means in the valve assembly. Although many alternatives may be available, it is preferred to locate detention pin 88, which is affixed to cavity back wall 74, within annular cavity 72 between first and second inlets 81, 82 opposite vacuum outlet 80. Inboard panel 54 of valve 50 has an arcuate slot 53 within which pin 88 is received, and has one terminus with detents **53*a* corresponding to the valve orientation of the first mode of operation and the other terminus with detents 53*b*** corresponding to the valve orientation required for the second mode of operation.

The valve 50 is preferably constructed of clear Phillips K Resin KROI, and is preferably sonically welded at the juncture of where D-shaped member 57 (FIG. 5) meets inside cylindrical side wall panel 56 and generally planar interior panel 58 which are preferably integral with outboard panel 52. A felt ring 90 is located within inboard facing annular recess 64 of circumferential flange 62 for a seal between valve and housing, and to prevent galling between the otherwise contacting surfaces thereof. The preferred embodiment also includes U-shaped gasket 92, preferably composed of a foamed plastic with exterior skins, that is affixed by glue or the like to cylindrical side wall panel 56, with base leg thereof running about the sonically welded seam between D-shaped member 57 and cylindrical side wall panel 56. Side legs of U-shaped gasket 92 are affixed to the cylindrical side wall panel 56 along the edge defined by the juncture of generally planar interior panel 58 and cylindrical side wall panel 56.

The assembly of the preferred embodiments of the valve and housing is by way of threaded knob 86 which engages threads in post 78. Valve 50 is thus rotatably retained within valve housing 70, but readily accessed for cleaning without the use of hand tools such as screwdrivers or the like. Moreover, this preferred embodiment has a length of slot 53 in valve 50 dimensioned to tightly slidably engage pin 88, and allow for a range of motion of the valve in the throttling mode but provide a frictional force deterring valve rotation due to normal vacuum cleaner vibration by way of felt ring 90.

By way of specific example as to the foregoing preferred embodiments, valve inboard panel 54 has an outside diameter of approximately 3 inches with thickness of $\frac{1}{8}$ inch, and valve outboard panel 52 has an outside diameter of 3 1/16 inches, of comparable thickness, and the panels spaced apart approximately $1\frac{3}{8}$ inch. Generally planar interior panel 58 is of approximately the same thickness and has a surface approximately 5/16 inch from the centers of outboard and inboard panels. Axial hole 71 diameter is approximately $\frac{1}{2}$ inch. Housing 70 has a cylindrical cavity 72 diameter of about 3.13 inches, and a cylindrical cavity wall 76 height of approximately 1.82 inches. Centered post 78 has an outside diameter of about 0.47 inch and a height of approximately 1.6 inches. Vacuum pipe 120, first outlet pipe 124, and second outlet pipe 122 have inside diameters of approximately 1.18 inches. Pin 88 is centered on an arc of approximately 1.03 inch from center post 78, and has approximately 0.30 inch diameter and is approximately 0.46 inch high.

It should be appreciated that the apparatus of the present invention is capable of being incorporated in the form of a variety of embodiments, only one of which has been illustrated and described above. The invention may be embodied in other forms without departing from its spirit or essential characteristics. For example, a detention means may be a number of different mechanical interactions between the rotating structure and the housing structure. As a further example, the orifices located on the valve housing may be reoriented with corresponding alteration of valve geometry. The described embodiments are to be considered in all respects only as illustrative and not restrictive and the scope of the invention is, therefore, indicated by the appended claims rather than by the foregoing description. Thus while the invention has been described with reference to a particular embodiment, modifications of structure, materials and the like would be apparent to those skilled in the art, yet still fall within the scope of the appended claims.

What is claimed is:

1. A diverter valve assembly for a vacuum cleaner with suction creating means, a floor cleaning member for carrying dirty air from a floor surface, and an accessory cleaning member for carrying dirty air from an off-floor surface, comprising:

a vacuum cleaner housing defining a cylindrical shaped cavity therein, a vacuum outlet orifice communicating with the suction creating means, located generally tangential to the cavity and in a first quadrant of said cavity, a first orifice communicating with the floor cleaning member, located generally normal to the cavity and in a second quadrant of said cavity, a second orifice communicating with the accessory cleaning member, located generally tangential to the cavity and in a third quadrant of said cavity, and a post affixed to the housing, extending into the cylindrical shaped cavity and parallel to the axis of the cylindrical shaped cavity, said post located between said vacuum cleaner housing and said cavity axis, about 180 degrees from said vacuum outlet orifice;

a clear plastic substantially cylindrical valve member having a centered cylindrical hole extending axially through inboard and outboard axial end walls, and an arcuate slot in said inboard end wall of said valve member adapted to receive said post therein, said valve member being slidably received in said housing cavity with said post received in the arcuate slot to allow for limited rotation of said member with respect to said housing, said valve member further defining an arcuate cavity open along the circumference of said member, with said axial end walls corresponding to the bases of said member, and an interior generally planar wall, said member having a flange extending from one base thereof and defining an annular recess therein with said recess opening toward the other base of said valve member;

an annular gasket received in said flange annular recess; and removable attachment means for rotatably retaining said cylindrical member within the housing cavity, whereby the member may be rotated with respect to the housing and allow the vacuum outlet orifice to effectively communicate with the first and second orifice.

2. A diverter valve assembly for routing airflow in a vacuum cleaner as between a floor cleaning mode of operation and an accessory mode of operation, comprising:

a generally cylindrical-shaped valving member having an axis, a circumferential sidewall, an inboard axial endwall, an outboard axial endwall, and an interior wall extending between said endwalls in a general plane generally parallel to said axis, said interior wall with said endwalls defining an axially cross-sectioned cylinder-shaped passage through said valving member which has an opening radially outwardly above said interior wall wherein said inboard endwall has an arcuate channel formed therein, a valving member housing in said vacuum cleaner within which said valving member is mounted for rotation about said axis, said valving member housing having an interior sidewall generally conforming to the shape of said valving member circumferential sidewall, and having formed therethrough a suction outlet orifice, a first inlet orifice and a second inlet orifice, said first and second inlet orifices respectively communicating with conduits to a floor cleaning member and an accessory member, said valving member housing including a post received within said arcuate channel in said inboard endwall, said post cooperating with said arcuate channel and constituting a stop to the rotation of said valving member at such point where said passage for airflow is aligned between said suction outlet orifice and one of said first or second inlet orifices;

said valving member when rotated within said housing selectively aligning said passage for airflow between said suction outlet orifice and one or both of said first and second inlet orifices, and removable attachment means for rotatably retaining said valving member within said valving member housing, whereby said valving member may be readily removed and cleaned.

3. A diverter valve assembly for routing airflow in a vacuum cleaner as between a floor cleaning mode of operation and an accessory mode of operation, comprising:

a generally cylindrical-shaped valving member having an axis, a circumferential sidewall, an inboard axial endwall, an outboard axial endwall, and an interior wall extending between said endwalls in a general plane generally parallel to said axis, said interior wall with said endwalls defining an axially cross-sectioned cylinder-shaped passage through said valving member which has an opening radially outwardly above said interior wall wherein said inboard endwall has an arcuate channel formed therein, a valving member housing in said vacuum cleaner within which said valving member is mounted for rotation about said axis, said valving member housing having an interior sidewall generally conforming to the shape of said valving member circumferential sidewall, and having formed therethrough a suction outlet orifice, a first inlet orifice and a second inlet orifice, said first and second inlet orifices respectively communicating with conduits to a floor cleaning member and an accessory member, said valving member housing including a post received within said arcuate channel in said inboard endwall, said post cooperating with said arcuate channel and constituting a stop to the rotation of said valving member at such point where said passage for airflow is aligned between said suction outlet orifice and one of said first or second inlet orifices, wherein said inboard endwall includes detents extending into said arcuate channel adjacent opposite ends thereof, said detents cooperating with said post to releasably secure said valving member in place at either of said opposite ends;

said valving member when rotated within said housing selectively aligning said passage for airflow between said suction outlet orifice and one or both of said first and second inlet orifices, and removable attachment means for rotatably retaining said valving member within said valving member housing, whereby said valving member may be readily removed and cleaned.

4. A diverter valve assembly for routing airflow in a vacuum cleaner as between a floor cleaning mode of operation and an accessory mode of operation, comprising:

a generally cylindrical-shaped valving member having an axis, a circumferential sidewall, an inboard axial endwall, an outboard axial endwall, and an interior wall extending between said endwalls in a general plane generally parallel to said axis, said interior wall with said endwalls defining an axially cross-sectioned cylinder-shaped passage through said valving member which has an opening radially outwardly above said interior wall wherein said inboard endwall has an arcuate channel formed therein, a valving member housing in said vacuum cleaner within which said valving member is mounted for rotation about said axis, said valving member housing having an interior sidewall generally conforming to the shape of said valving member circumferential sidewall, and having formed therethrough a suction outlet orifice, a first inlet orifice and a second inlet orifice, said first and second inlet orifices respectively communicating with conduits to a floor cleaning member and an accessory member, said valving member housing including a post received within said arcuate channel in said inboard endwall, said post cooperating with said arcuate channel and constituting a stop to the rotation of said valving member at such point where said passage for airflow is aligned between said suction outlet orifice and one of said first or second inlet orifices, wherein said inboard endwall includes detents extending into said arcuate channel adjacent opposite ends thereof, said detents cooperating with said post to releasably secure said valving member in place at either of said opposite ends;

said valving member when rotated within said housing selectively aligning said passage for airflow between said suction outlet orifice and one or both of said first and second inlet orifices, wherein said first and second inlet orifices are located about 150 degrees apart, and removable attachment means for rotatably retaining said valving member within said valving member housing, whereby said valving member may be readily removed and cleaned.

* * * * *